US006161766A

United States Patent [19]

Goba

[11] Patent Number: 6,161,766

[45] Date of Patent: Dec. 19, 2000

[54] REFRIGERATION EXPANSION VALVE HAVING A PORT TO WHICH A PRESSURE-MEASURING DEVICE MAY BE CONNECTED

[76] Inventor: Stephen M. Goba, 601 S. Ahrens Ave., Lombard, Ill. 60148

[21] Appl. No.: 09/389,741

[22] Filed: Sep. 7, 1999

[51] Int. Cl.[7] ..... G05D 27/00

[52] U.S. Cl. ..... 236/92 B; 62/125; 62/129; 62/225

[58] Field of Search ..... 62/125, 129, 225; 236/72 B

[56] References Cited

U.S. PATENT DOCUMENTS

| | | | |
|---|---|---|---|
| 2,214,298 | 9/1940 | Gilbert, Sr. | 62/125 |
| 3,822,563 | 7/1974 | Orth | 62/225 |
| 3,937,029 | 2/1976 | Grahl et al. | 236/92 B |
| 6,012,301 | 1/2000 | Fujimoto et al. | 236/92 B |

*Primary Examiner*—William E. Tapolcai
*Assistant Examiner*—Mohammad M Ali
*Attorney, Agent, or Firm*—Robert L. Marsh

[57] ABSTRACT

The housing of a refrigeration expansion valve has a port which is in communication with the pressure feed back chamber of the valve. A pressure gauge may be attached to the port to read the pressure of the refrigerant discharged from the evaporator.

2 Claims, 2 Drawing Sheets

REFRIGERATION EXPANSION VALVE HAVING A PORT TO WHICH A PRESSURE-MEASURING DEVICE MAY BE CONNECTED

The present invention relates to thermostatic expansion valves used in refrigeration systems, and in particular to an improved expansion valve having a port to which a pressure-measuring device may be connected.

BACKGROUND OF THE INVENTION

A refrigeration system employs the law of thermodynamics to remove heat from a chamber by evaporating a liquid refrigerant in an evaporator within the chamber, and condensing the refrigerant outside the chamber in a condenser. A compressor pumps the refrigerant through the system. To operate properly, the pressure of the liquefied refrigerant from the condenser should be reduced until it is below the evaporation points as it enters the evaporator. To regulate the pressure and flow rate as the liquid enters the evaporator, the circuit includes a refrigeration expansion valve which controls pressure and flow rate by regulating the size of an aperture through which the liquid flows, reducing the size of the aperture to reduce the pressure and the flow rate in the tube to the evaporator, and opening the aperture to increase the pressure and the flow rate in the tube. The ideal volume of refrigerant entering the evaporator is dependent upon the temperature and pressure of the refrigerant in the tube leaving the evaporator and, therefore, the expansion valve includes temperature and pressure sensing devices for receiving temperature and pressure readings from the output end of the evaporator. For a refrigeration system to operate efficiently, the expansion valve must maintain a flow of refrigerant through the evaporator such that there is at least some small amount of unevaporated (liquid) refrigerant still present at the outlet of the evaporator, and to the extent that all the liquid refrigerant evaporates before it reaches the outlet of the evaporator, the efficiency of the system is reduced. The servicing of a cooling system, therefore, includes the maintenance of the compressor, the condenser, the evaporator, and the expansion valve.

The system is made of metal parts carefully brazed together because a refrigerant leak in the circuit would ultimately lead to a system failure. The circuits of existing refrigeration systems, therefore, ideally employ the minimum number of brazings, and, in the interest of minimizing the number of brazings, do not always include a sufficient number of ports which could be used by a technician to measure pressure at critical areas within the system such as at the outlet of the evaporator. Consequently, the pressure of the refrigerant leaving the evaporator of a system cannot normally be measured. A technician servicing the system therefore cannot determine whether the expansion valve is operating efficiently without cutting tubes and installing one or more ports through which the pressure in the tubes may be read. The installation of such pressure ports, however, is a time consuming task which, due to the necessity of creating brazed joints, enhances the likelihood of a refrigerant leak. It would be desirable, therefore, to provide an improved expansion valve which allows the pressure within the tube from the evaporator to be monitored without requiring the tubes in the system to be cut.

SUMMARY OF THE INVENTION

Briefly, the present invention is embodied in an expansion valve having a housing with a plurality of ports, including an input port for receiving liquid refrigerant from a condenser, an output port for discharging refrigerant to an evaporator, and a regulating means within the housing for controlling the volume of liquid discharged to the output port. The valve further has a temperature sensing port having a means therein for sensing the temperature of the refrigerant leaving the output end of the evaporator and a pressure feedback port and chamber connected by a feedback tube from the output end of the evaporator.

In accordance with the present invention, the housing of the valve further includes a fifth port in communication with the pressure feedback chamber and a valve in the fifth port to which a pressure gauge can be attached to enable a technician to read the pressure of the refrigerant in the pressure feedback chamber. The pressure of the refrigerant in the pressure feedback chamber is the pressure of the refrigerant discharged from the evaporator, therefore, by reading this pressure a technician will know the pressure of refrigerant leaving the evaporator.

BRIEF DESCRIPTION OF THE DRAWINGS

A better understanding of the present invention will be had by reading the following detailed description taken in conjunction with the following drawings wherein.

DETAILED DESCRIPTION OF THE PREFERRED EMBODIMENT

Figure 1:
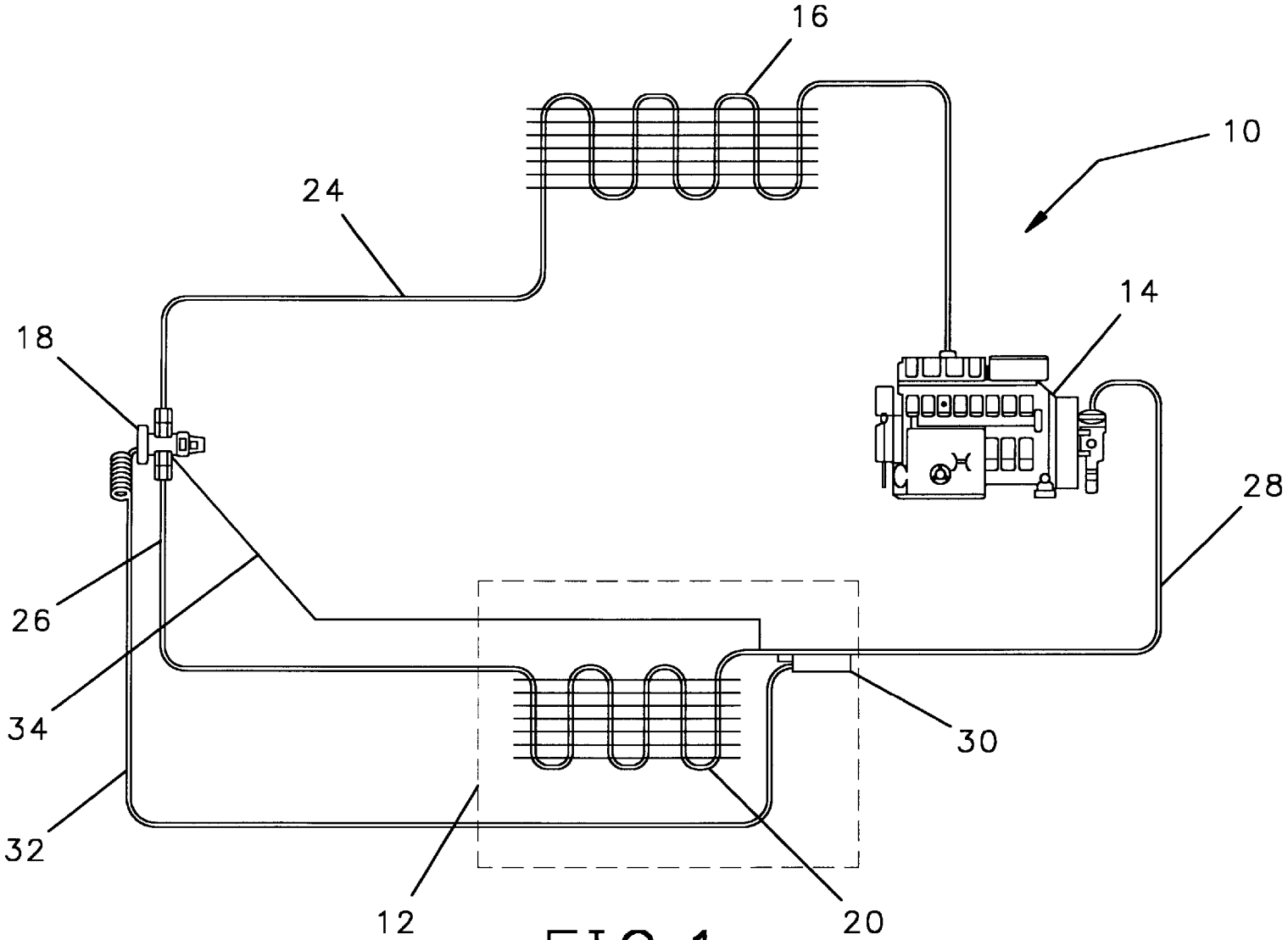
FIG. 1 is a schematic diagram of a refrigeration system, including an expansion valve in accordance with the present invention.

Referring to FIG. 1, a refrigeration system 10 is used to cool the interior of a refrigeration chamber 12 and includes a compressor 14, a condenser 16, a metering device (in this case, an expansion valve) 18 and an evaporator 20. The condenser 16 has a serpentine coil of tubing in which a gaseous refrigerant received through an input tube 22 connected to the compressor 14 is condensed and liquefied. The liquefied refrigerant from the condenser 16 is discharged through a tube 24 connected to the expansion valve 18, and the output tube 26 from the expansion valve 18 leads to the evaporator 20. Under ideal circumstances, the pressure of the refrigerant entering the evaporator 20 is below the evaporation pressure. The evaporator 20 includes a second serpentine coil of tubing positioned within the interior of the refrigeration chamber 12. As the refrigerant within the evaporator 20 evaporates, its temperature falls, and it draws heat from the interior of the refrigeration chamber 12 thereby cooling the interior of the chamber. Refrigerant from the evaporator is returned through tube 28 to the compressor 14 where it is again pressurized.

The system further includes a temperature sensor 30 positioned at the output of the evaporator 20 which is connected by a capillary tube 32 to the expansion valve 18 and a pressure feedback tube 34 connected to the output of the evaporator for transmission of evaporator outlet pressure to the expansion valve 18.

Figure 2:
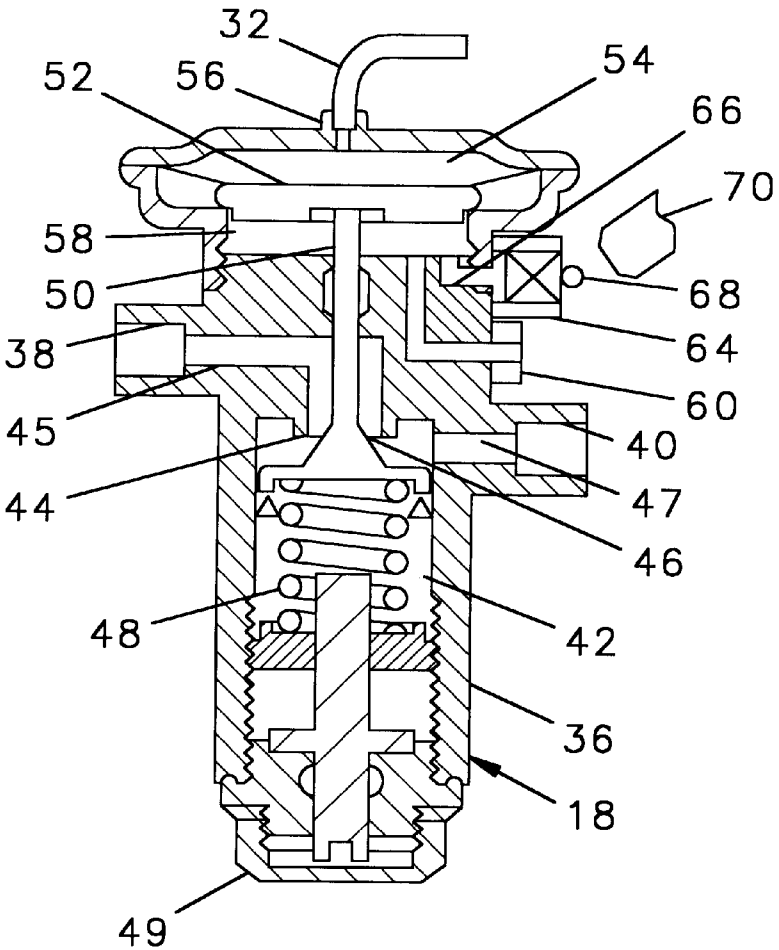
FIG. 2 is a cross sectional view of an expansion valve in accordance with the present invention.

Referring to FIG. 2, the expansion valve 18 has a housing 36 with a first input port 38 for attachment to tube 24 for receiving liquefied refrigerant from the condenser 16. A second output port 40 is connected to tube 26 through which a mixture of gaseous and liquefied refrigerant at a reduced pressure is directed to the evaporator 20. Between the input port 38 and the output port 40 is a chamber 42 having an aperture 44 therein in communication through bore 45 with the input port 38 for receiving the mixture of gaseous and liquid refrigerant into the chamber 42. A second bore 47 connects the chamber 42 to the output port 40. A valve pin 46 having a tapered body is axially moveable toward and away from the aperture 44 such that moving the valve pin 46 towards the aperture 44 constricts the opening of the aperture and movement of the valve pin 46 away from the aperture, widens the aperture, thereby regulating the flow of liquid from the input port 38 to the output port 40. A coil spring 48 between housing 36 urges the valve pin toward the aperture 44 and a screw 49 permits a technician to adjust the pressure in the spring 48. A valve stem 50 connects the valve pin 46 to the center of a circular diaphragm 52. Above the diaphragm 52 is an upper chamber 54 having a port 56 extending through the housing 36 thereof to which the capillary tube 32 from the temperature sensor 30 is connected. A second chamber 58 positioned below the diaphragm 52 is in communication with through a bore to a fourth port 60 to which the feedback tube 34 is attached. As can be seen, the movement of the valve pin 46 toward and away from the aperture 44 is controlled by the application of several forces. The coil spring 48 and the pressure within the lower chamber 58 urge the valve pin 46 toward the aperture 44 to restrict the flow of refrigerant, and the pressure in the upper chamber 54 and the pressure of the liquid refrigerant from the input tube 24 urge the valve pin 46 outward of the aperture to thereby increase the flow of refrigerant in the output tube 26. The operation of the valve 18 can be adjusted by turning the screw 49.

To reduce the potential for leakage in a refrigeration system, installers assemble the parts with unbroken tubes connecting the ports so as to employ a minimum number of brazings. A service technician who seeks to monitor the pressure of the refrigerant at the outlet of the evaporator, therefore, cannot do so without cutting one of the tubes and inserting a T-fitting with a valve to which a pressure gauge can be attached. It can therefore be appreciated that a technician will expend considerable time and increase the likelihood of a refrigerant leak if he chooses to insert such pressure valve, and the technician must therefore either evaluate the system without knowing the pressure at the evaporator outlet or choose to increase the cost of the repair and the likelihood of a refrigerant leak by installing such pressure valve.

In accordance with the present invention, the housing 36 of the valve 18 has a fifth port 64 having a boring 66 leading therefrom to the lower chamber 58, and fitted within the fifth port 64 is a pressure valve 68. A technician seeking to monitor the operation of the valve 18 may determine the pressure of the refrigerant at the output of the evaporator by connecting a pressure gauge 70 to the pressure valve 68 in the port 64 because the pressure in the lower chamber 58 is the same as that coming out of the evaporator 20.

As can be seen, a refrigeration system employing a valve 68 in accordance with the present invention would enable a technician to monitor the pressure of the refrigerant therein without requiring the technician to cut the tubes of the system and thereby increasing the cost of the repair and the likelihood of a refrigerant leak as has been required prior to the present invention.

Figure 3:
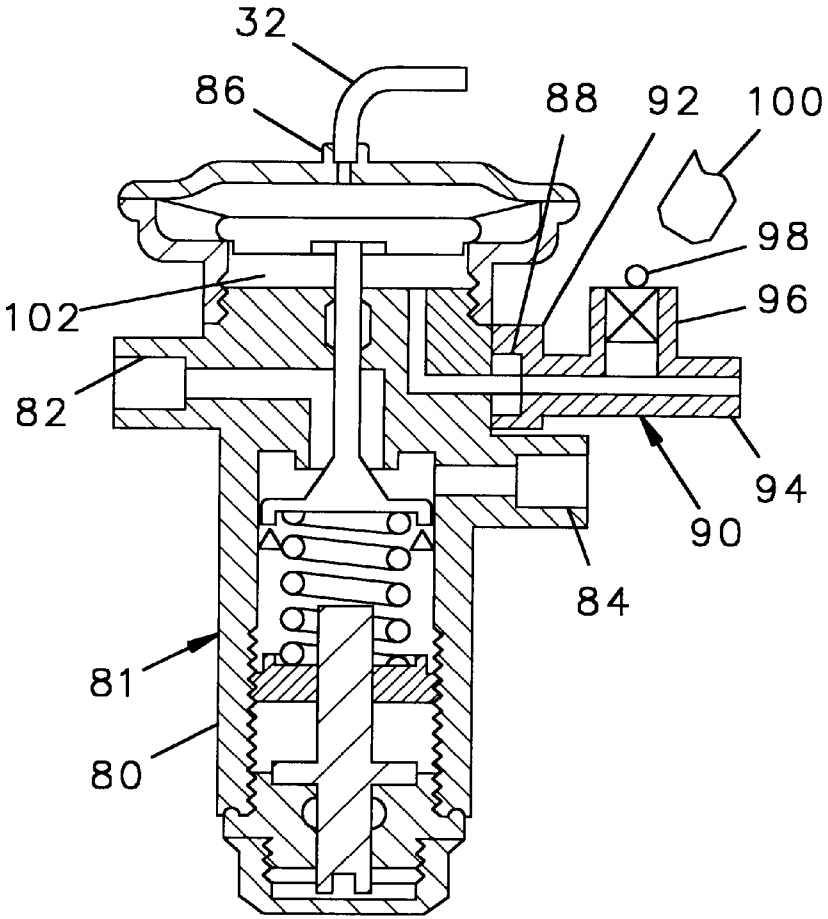
FIG. 3 is an expansion valve in accordance with a second embodiment of the present invention.

Referring to FIG. 3, in a second embodiment, the housing 80 of a valve 81 has an input port 82 for connection to the input tube 24, and output port 84 for connection to the output tube 26, a temperature sensor port 86 for connection to a temperature sensor capillary tube 32, and a pressure feedback port 88 for connection to a pressure feedback tube 34. In accordance with this embodiment, a T-fitting 90 has a first port 92 attached to the pressure feedback port 88 and a second port 94 to which the pressure feedback tube 34 can be attached. The third port 96 of the T-fitting 90 is fitted with a pressure valve 98 to which a pressure gauge 100 may be attached for reading the pressure within the second chamber 102.

In this embodiment the fitting 90 is assembled to the valve 81 in a controlled environment such as in a construction plant such that the brazing retaining the fitting 90 to the valve 81 will not leak when subjected to high pressures and varying temperatures over long periods of time. The valve 81 with the fitting 90 attached thereto is suitable for use by installers of refrigeration systems such that no additional brazing steps are required to determine the pressure at the outlet of the evaporator.

While the present invention has been described with respect to two embodiments, it will be appreciated that many modifications and variations may be made without departing from the true spirit and scope of the present invention. Therefore, it is the intent of the appendant claims to cover all such modifications and variations which fall within the true spirit and scope of the invention.

What is claimed:

1. A refrigeration expansion valve comprising a housing having a first port, a second port, a third port, and a fourth port;

said first port for attachment to an input tube for receiving liquefied refrigerant from a condenser;

said second port for attachment to an output tube for directing refrigerant to an evaporator;

means within said housing for regulating the flow of liquid from said input port to said output port;

said third port for receiving a temperature sensor means;

said housing having a chamber in communication with said fourth port;

said fourth port for attachment to a pressure feedback tube;

said housing having a fifth port in communication with said chamber; and a pressure valve in said fifth port whereby a pressure gauge may be attached to said fifth port for monitoring the pressure in said chamber.

2. The combination comprising a refrigeration expansion valve having an input port, an output port, a third port for receiving a temperature sensing means, and a fourth port for attachment to a pressure feedback tube, a T-fitting having a first port, a second port and a third port, said first port of said T-fitting brazed to said fourth port of said refrigeration expansion valve, and a pressure valve in said second port, said pressure valve for receiving a pressure measure device.

* * * * *